US005382012A

United States Patent [19]

Mandel et al.

[11] Patent Number: 5,382,012

[45] Date of Patent: Jan. 17, 1995

[54] MULTIPLE SECTION SHEET SORTER WITH STACKING TRAY POSITIONED THERE BETWEEN

[75] Inventors: Barry P. Mandel, Fairport; Charles F. Prevost; Charles D. Rizzolo, both of Rochester; Frederick A. Green, Fairport; Richard A. Van Dongen, Newark, all of N.Y.

[73] Assignee: Xerox Corporation, Stamford, Conn.

[21] Appl. No.: 161,615

[22] Filed: Dec. 6, 1993

Related U.S. Application Data

[63] Continuation-in-part of Ser. No. 54,943, Apr. 27, 1993, Pat. No. 5,342,034.

[51] Int. Cl.[6] ..... B65H 39/10; B42C 1/12

[52] U.S. Cl. ..... 270/53; 270/58; 271/293; 271/296; 271/303

[58] Field of Search ..... 271/289, 292, 293, 296, 271/303; 270/58, 53

[56] References Cited

U.S. PATENT DOCUMENTS

| | | | |
|---|---|---|---|
| 4,072,420 | 2/1978 | Wicks et al. | 271/303 X |
| 4,361,320 | 11/1982 | Kikuchi et al. | 271/296 X |
| 4,676,499 | 6/1987 | Kimizuka et al. | 271/289 X |
| 4,691,914 | 9/1987 | Lawrence . | |
| 5,098,074 | 3/1992 | Mandel et al. . | |
| 5,137,265 | 8/1992 | Sato et al. . | |

FOREIGN PATENT DOCUMENTS

| | | | |
|---|---|---|---|
| 59-97963 | 6/1984 | Japan | 271/293 |
| 59-158763 | 9/1984 | Japan | 271/293 |
| 1-288568 | 11/1989 | Japan | 271/293 |
| 3-102065 | 4/1991 | Japan | 271/303 |
| 1401465 | 7/1975 | United Kingdom | 271/289 |

OTHER PUBLICATIONS

IBM Technical Disclosure Bulletin, vol. 18 No. 7 Dec. 1975, M. D. Avritt.

*Primary Examiner*—Edward K. Look
*Assistant Examiner*—John Ryznic

[57] ABSTRACT

In a sheet output module for the collection and stacking of printed media sheets from the output of a reproduction apparatus, with multiple separate sheet collection bins in a vertical array, a sheet input for receiving the sheets, and a sheet transport path for transporting the sheets to a selected bin; the sheet input is at a central vertical level intermediately of the module and the vertical bin array, the vertical bin array is divided into first and second portions with a central vertical space therebetween, the sheet transport path has a common shared central path from the input to a branching position where it arcuately branches in opposite directions, with a first branch path extending upwardly to feed sheets to the first portion of the bins and a second branch path extending downwardly to feed sheets to the second portion of the bins. A sheet deflector gate is located at this branching position for selectively deflecting sheets from a the common shared path portion into one of these first and second branch paths. A high capacity stacking tray is located within this vertical space between the first and second portions of the vertical array of bins.

9 Claims, 4 Drawing Sheets

MULTIPLE SECTION SHEET SORTER WITH STACKING TRAY POSITIONED THERE BETWEEN

This is a continuation-in-part of a copending application by the same Barry P. Mandel and Richard A. VanDongen, filed Apr. 27, 1993 as U.S. application Ser. No. 08/054,943. now U.S. Pat. No. 5,342,034 and entitled "Mailbox/Compiler Architecture", Attorney Docket No. D/92332Q. Incorporation by reference is made thereof as well as claiming the benefit of the priority date thereof. Also cross-referenced and incorporated herein are the following additional commonly assigned co-pending applications (and art cited therein) on the subject of mailboxing, with one or more inventors in common; application Ser. No. 08/054,502, D/92332; application Ser. No. 08/067,494, D/92611; and applicaton Ser. No. 08/057,069, D/93185.

There is disclosed in the embodiment herein an integral output plural mode sheet sorting and stacking system capable of independently handling and separating different jobs for different users or addressees automatically and/or alternately stacking large and/or multiple jobs in a high capacity stacker, in a compact shared unit.

More particularly, there is disclosed in this embodiment a compact integrated sheet output unit with a high capacity sheet stacker and multiple sorter or mailbox bins in an improved modular configuration with an improved paper path.

Disclosed in this embodiment is an improved "mailbox" or sorter system for automatically discretely handling and segregating received sheets (from a copier, scanner, facsimile, multi-mode or other such printer outputs) with a desirable mid-level sheet entrance.

The disclosed "mailboxing" or sorter unit embodiment can desirably be a universal modular or standalone unit that may be attached to, or even simply moved next to, the output of almost any conventional copier or printer, including facsimile machines or networked electronic mail printers.

For mailboxing, fixed bins systems (requiring longer paper paths) are preferable to moving bins type sorters. Moving bin sorters are not desirable for mailbox systems for bin unloading operability reasons. They are unlike sorter systems, which hold only plural sets of one single users job, and stop after set completion. A mailbox system holds many different users jobs in different bins and can start up at any time, including times while other bins are being unloaded. If the bins of a mailbox system started to move when someone was unloading their job, it could be disturbing to the user. Furthermore, since moving bin systems typically collapse the bins as they move past the sheet input location, that could pinch the users hand. Also, although moving bins systems can have shorter sheet transport paths, they have difficulty moving the bin array fast enough to provide rapid random access to any bin rather than just sequential adjacent bin access. Large multiple fixed bin sorters have other advantages over moving bin sorters, such as not requiring a high powered elevator motor to rapidly vertically move the weight of all bins when they are all filled with stacked sheets, and not having external exposed moving components. However, most fixed bin sorters and mailbox systems require particularly long paper paths, in order to sequentially transport sheets past all of the desired multiple bins or trays, since the sheet may be taken from such an elongated transport into any one or more of these bins, i.e, variably selectively deflected from the elongated transport path for stacking into a particular bin or bins. Thus, the sheet transports of such multibin sorters, collators or mailbox systems present particular design and cost problems.

By way of background, the following additional partial broad definitions may be helpful to the discussions herein: "Mailbox[ing]": temporarily (or semi-permanently) assigning a unique predetermined electronic address to designated ones of plural bins of a sorter-like output device and enabling a user's output to be directed into a selected bin so assigned. It may or may not include locked bins with privacy doors. Preferably, the user's mailbox output is plural, pre-collated, jobs with all sheets going to a single bin, not requiring sorting. "Sorting": conventionally, this refers to sending one copy sheet of each original page into one bin of a sorter, the next copy sheet into the next bin, etc., repeated for the number of copies, until each of the plural bins required has one copy, then stacking one copy sheet of the next original in each said bin, etc, to compile one collated set in each bin. Thus, job or addressee "mailboxing" is not "sorting" in the common or usual sense of a collating plural identical copy sheets by sequentially placing each sheet in a different bin, and repeating those steps. However, similar "sorter" hardware may be employed in part if it can provide rapid random bin access and other desired features. "Stacking": providing the ability to arrange sets of sheets (which may be stapled or otherwise finished sets of sheets), into a well controlled, generally vertical, common stack, although partial "offsetting" of separate job sets may be desirable.

To express it in another way, a "mailbox" in the example herein takes multiple print jobs from a printer (from user terminals, fax, networked page images, scanned document jobs, or the like, or combinations thereof) and separates jobs by users and stacks these hardcopy outputted print jobs into individual bins for individual users, by users. [As an additional software option, users may also send print jobs to other users' mailbox bins if desired.] Mailbox bins can, in general, be either user assignable, or automatically assigned by the printer, print server, or mailbox unit. Optionally, jobs can be individually stapled if a stapler unit is provided. Optional privacy or security doors can be added to any or all bins if desired. An overflow bin or general, shared, stacking tray may also desirably be provided, not assigned to any one user.

A specific feature of the specific embodiment disclosed herein is to provide a sheet output module for the collection, separation and stacking of printed media sheets received from the output of a reproduction apparatus, with multiple separate sheet collection bins in a vertical array, a sheet input for receiving the print media sheets from the output of the reproduction apparatus, and a sheet transport path for transporting the sheets from said sheet input to a selected said bin, the improvement wherein: said sheet input is at a vertical level intermediately of said module and said vertical bin array; said vertical bin array is intermediately divided into first and second portions with a vertical space therebetween; said sheet transport path has a common shared path portion from said central sheet input to a branching position where said sheet transport path branches arcuately in opposite directions, with a first branch path extending upwardly to feed sheets to said first portion of said bins and a second branch path extending downwardly to feed sheets to said second portion of said bins; a sheet deflector gate is mounted at said branching position for selectively deflecting sheets from said common shared path portion into one of said first and second branch paths; and a high capacity stacking tray is located within said vertical space between said first and second portions of said vertical array of bins also connecting with said sheet transport path to receive said print media sheets.

Further specific features disclosed herein, individually or in combination, include those wherein said sheet transport path is in the general shape of a rotated "T"; and/or wherein said first and second branch paths extend past said respective first and second portions of said vertical array of bins; and/or wherein said first and second portions of said bins comprise approximately equal halves of said vertical array of bins; and/or wherein said sheet deflector gate is activated by movement of a movable compiler/finishing unit between said first and second portions of said vertical bin array: and/or wherein said compiler/finishing unit is between said first and second branch paths and said bin array, and feeds said printed media sheets from a selected first or second branch path to a selected said bin; and/or wherein said sheet transport path further includes a bypass extension path system to feed sheets on to said central sheet input of a second said sheet output module, said bypass extension path being at a vertical level intermediately of said module and said vertical bin array and communicating with said common shared path portion from said central sheet input to said branching position and then extending on from between said first and second branch paths.

One desirable feature of "mailbox" bins or stacking trays is to store plural (more than one) bound (e.g. stapled) sets in a selected assigned one or more mailbox bins or stacking tray (i.e. so that any particular user-designated bin can store plural stapled sets from the same or different jobs). Noted in this regard is Xerox Corporation U.S. Pat. No. 5,098,074 issued Mar. 24, 1992 to the same Barry P. Mandel, et al (D/88157), especially FIG. 4 and its description, and the last paragraph of the specification, and the corresponding abstracted "Xerox Disclosure Journal" publication Vol. 16, No. 5, pp. 281–283 dated Sept./Oct. 1991.

Also disclosed of interest in said U.S. Pat. No. 5,098,074 patent is a partial (shared with a tray) compiler shelf, tamper, stapler, eject rolls, stack height sensor, elevator high capacity stacker, and other hardware of interest to the embodiment herein. Further noted with respect to partially shared (with a tray) compiler/-stackers is Canon U.S. Pat. No. 5,137,265.

Of further "mailbox" background interest is Seiko Epson Corporation U.S. Pat. No. 5,141,222 issued Aug. 25, 1992 by Shigeru Sawada, et al., (and its equivalent EPO Application No. 0 399 565, "Printer", published Nov. 28, 1990). U.S. Pat. No. 4,691,914 issued Sep. 8, 1987 to F. J. Lawrence (Gradco Systems, Inc.) discloses a random plural bin access [with plural solenoids] sheet receiver. It discloses sheet input from both the right or left sides, indicated as from a copier and a printer respectively. Gradco Systems, Inc. U.S. Pat. No. 4,843,434 filed Nov. 17, 1987 and issued Jun. 27, 1989 to F. Lawrence et al has a brief discussion of "mailboxing" for electronic or laser printers in Col. 1, lines 28 et al., noting in particular there that: "mailboxing is more difficult, because the documents or jobs destined for different mailboxes may not and most likely will not be processed in sequence. Thus, mailboxing requires random access or positioning of the sheet feed for delivery to a selected bin or mailbox." [Col. 1 lines 37–42]. This specification then goes on to indicate that rapid bin movement is a problem for that in the prior art sorters, and that it provides high speed job separation and ease of random access operation.

As to usable specific or alternative hardware components of the subject apparatus, it will be appreciated that, as is normally the case, some such specific hardware components are known per se in other apparatus or applications. For example, various commercially available stand-alone, self-controlled modular sorter units are known for sorting the output of xerographic copiers or printers, with various hardware systems. Examples include above-cited art and its references.

The presently disclosed apparatus may be readily operated and controlled in a conventional manner with conventional control systems. It is well known in general and preferable to program and execute such control functions and logic with conventional software instructions for conventional microprocessors. This is taught by various patents and various commercial copiers, printers, and sorters. Such software may of course vary considerably depending on the particular function and the particular software system and the particular microprocessor or microcomputer system being utilized, but will be available to or readily programmable by those skilled in the applicable arts without undue experimentation from either verbal functional descriptions, such as those provided herein, or prior knowledge of those functions which are conventional, together with general knowledge in the software and computer arts. Controls may alternatively be provided utilizing various other known or suitable hard-wired logic or switching systems.

All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus, the present invention will be better understood from this description of one embodiment thereof, including the drawing figures (approximately to scale) wherein:

Figure 1:
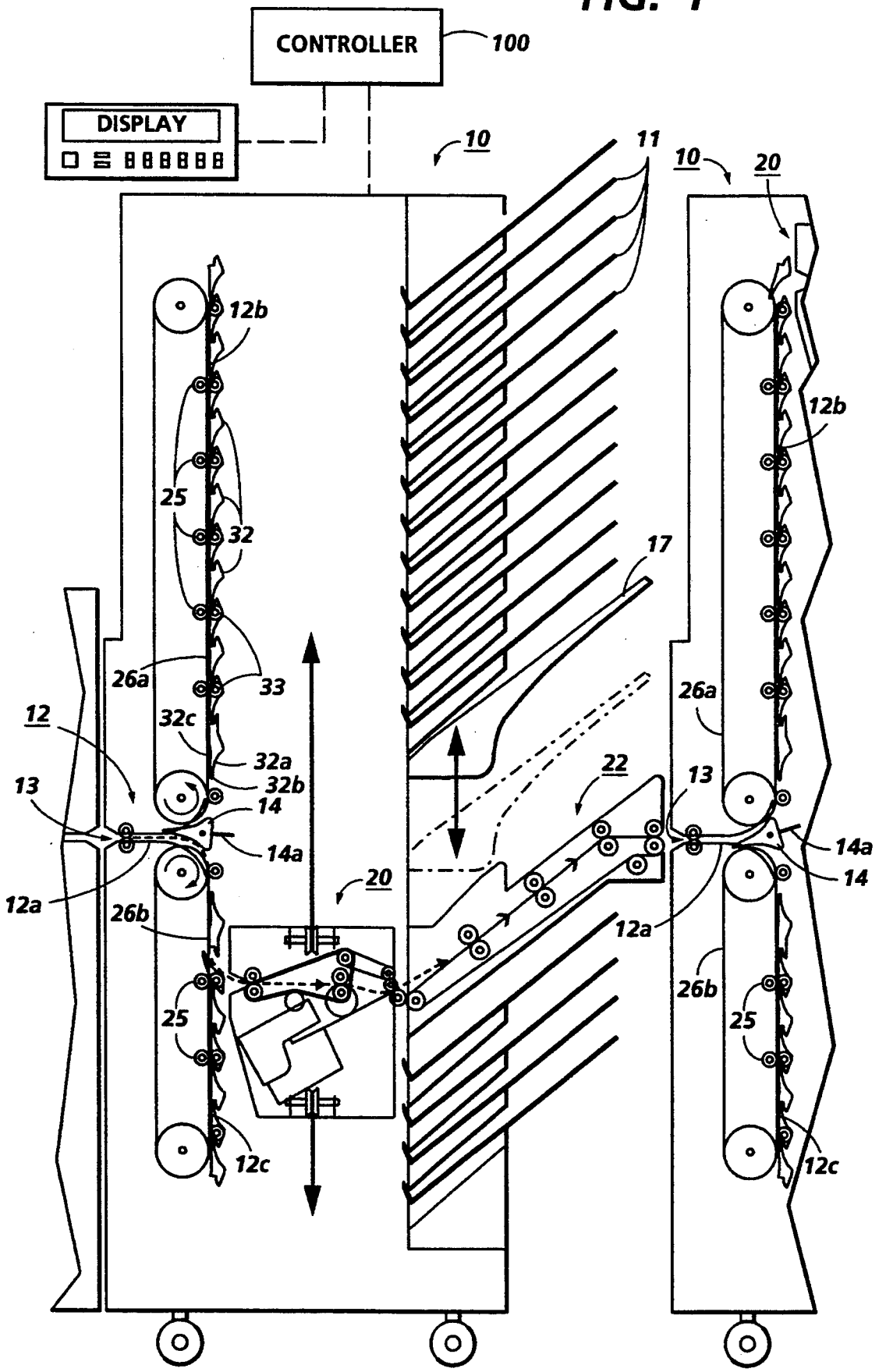
FIG. 1 is a schematic frontal view, partially in cross-section, of one embodiment of a central level side entrance mailbox/finisher/stacker module incorporating the subject system, also showing the output portion of a printer input, and also showing a second such module in series therewith via an integral interconnect transport module.
Figure 2:
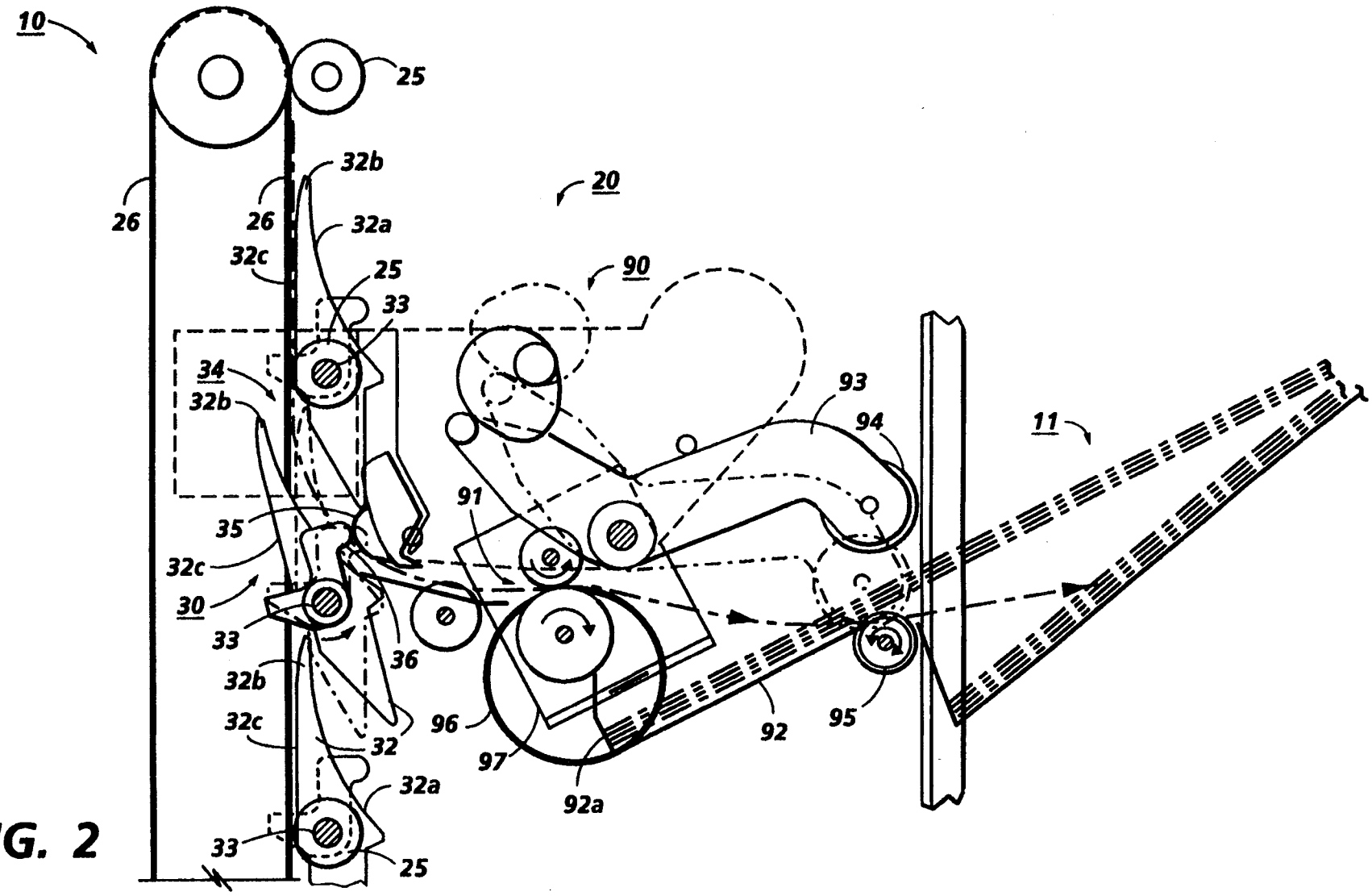
FIG. 2 is an enlarged partially schematic frontal view of an exemplary compiler/finisher carriage generally similar to that in FIG. 1.
Figure 3:
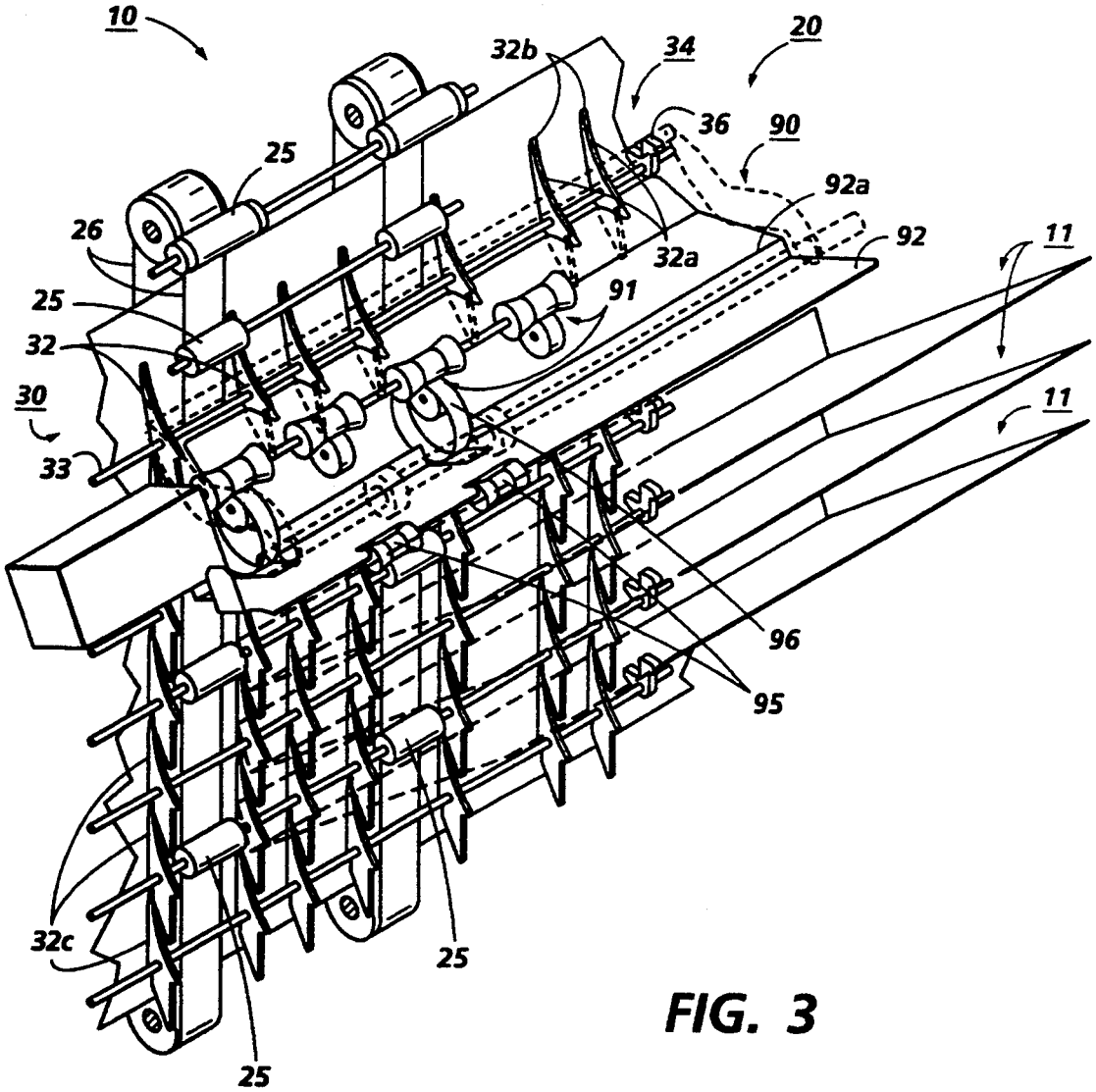
Figure 4:
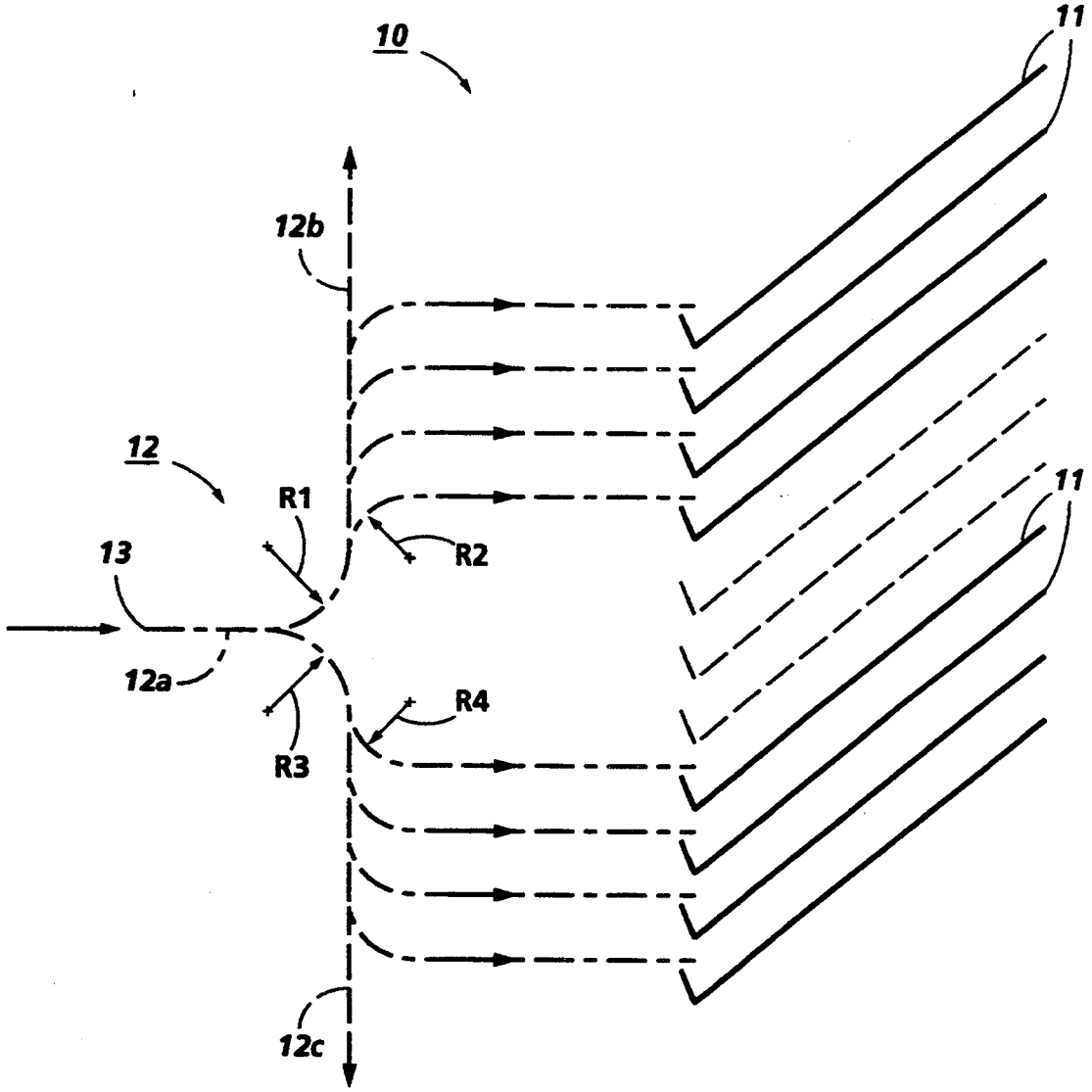

FIG. 3 is a partial perspective view illustrating a sheet bin selection system for compiler/finisher carriage FIG. 2, which is also usable for the alternative module of FIG. 1; and FIG. 4 is a partial schematic illustration of the sheet path and the spacing between bins of the module and system of FIG. 1 (the central missing bins are illustrated here in phantom, are to show the unusable bin spaces).

Turning now to the exemplary embodiment 10 of an integrated stacker and multibin mailbox [or sorter] unit shown in the Figures, it will be appreciated that this is merely one example of the claimed system. The printer to which the mailbox system may be operatively connected is only partially shown, for its output at the left side of FIG. 1, since various printers may be so connected to this unit 10, with little or no printer modifications. The illustrated mailbox bins, compiler/stapler, etc., illustrated or described herein are also exemplary, and may individually vary considerably. The general reference number 10 is utilized below for the entire output unit or module. Likewise, the general reference number 11 will be used throughout for any individual mailbox (or sorter) tray or bin.

The specific example illustrated is a mailbox/finisher/stacker module 10 with a sheet path 12 that is desirably fed sheets (entered) at a central or intermediate sheet entrance 13 level at one side thereof. The sheets are fed into a common path portion 12*a*, and then into one of two split path vertical sheet transports 12*b* or 12*c* respectively branching up or down, as selected by a gate 14.

As will be further noted, this central sheet path deflector gate 14 may be switched or actuated here into either an up or down position simply by the motion of a finishing carriage 20. Therefore, this gate 14 requires no additional electronics or logic.

The vertical array of bins 11 here are in two sets, vertically spaced apart. A high capacity (elevator) output tray 17 is located near or slightly below the center of the mailbox bins array in that space. This tray 17 location, relative to the sheet path 12*a* and its entrance 13, yields optimum unload height for the high capacity tray 17 and also minimum first copy output time for such copying jobs (e.g. from multifunction machines). Previous designs compromised one or more of these factors. The "T" sheet path configuration 12*a*, 12*b*, 12*c* results in shorter average and more reliable paper paths to the respective bins 11 as well as to the elevator stacking tray 17 (which can handle the widest array of sizes/-materials), and also a shorter path to a central bypass transport such as 22.

Although a finisher unit or carriage 20 is shown here, it is not required, and similar advantages here can be provided in a non-finishing sorter or mailbox module. This particular moving compiler/finisher unit 20 is merely exemplary. Although there are slight differences in, e.g., the stapler orientation, width, and an additional sheet input path feeding nip in the finishing carriage 20 of FIG. 1 versus the alternative of FIG. 2 [from the above cross-referenced applications], they are otherwise sufficiently similar for purposes of this description such that common numbering may be utilized here. The wider carriage and extra nip of FIG. 1 is for allowing the stapler to move in and out along the registration (rear) edge of the compiled set, for landscape or other multiple stapling, and is not relevant to this application.

By way of background, in order to provide good unload operability, it is desirable for mailbox devices to utilize fixed bins 11 rather than a moving bins design. A multiple gate and vertical sheet transport system, as shown here, enables very reliable bin entrance paper paths, as well as a small module 10 footprint. Existing known fixed bin sorters and mailboxes with multiple-gate (dedicated individual gate) bin entrance systems have a vertical transport that is entered from either the top or the bottom thereof. These systems also typically have a common bin entrance gate/nip geometry for all bins. In those systems, if the sheet exit height of the printer or other sheet processor does not line up with either the top or bottom of the sorter or mailbox units' vertical transport, then an additional interface transport is required to direct sheets to the top or bottom of the unit. A multiple gate sorter or mailbox system with a vertical transport that is entered from a central level is not known to the inventors here.

One reason for that is shown in FIG. 4. A central entrance to the bin array would be expected to result in considerable "wasted" space in the center of the bin array (shown by phantom unusable bin spaces) to allow for the requisite oppositely oriented paper path minimum turning radii such as R1, R2, R3 and R4, curving in opposite directions to turn the sheet up (or down) and then horizontally into a bin. If a typical minimum desirable turning baffle radius of 50 mm is used, such lost vertical spacing (unusable for bins) would be about 4 times that (R1+R2+R3+R4), or 200 mm. That is, the minimum unusable spacing between the two sets of bins that lie above and below the intermediate paper path entrance point to the vertical transports is roughly equal to four times the required minimum baffle or deflector bend radius. Another reason is that entering a fixed bin sorter system from a central point also means that the bin entrance direction and thus the requisite gate configuration is different for the bins above the entrance point than it is for those bins below that point (although the entrance gates may be common parts, mounted inverted, as 32 here). That is, R2 and R4 are oppositely curved. A further reason is that a central path entrance would be expected to require an extra gate actuator such as a solenoid to move a gate such as 14 to select between directing sheets to the upper or lower bin array.

The mailbox/finisher module 10 here makes effective use of a desirable center entrance paper path, yet overcomes the above-noted and other expected disadvantages. It yields a configuration with several significant advantages over previous systems. As shown, the sheet vertical transport here consists of two separate and oppositely driven belt transports defining branch paths 12*b* and 12*c* respectively providing upper and lower sheet paths selected by a center entrance gate 14 therebetween. Here, that gate 14 may be actuated solely by being contacted and moved by the motion of the finishing carriage 90. The gate 14 thus requires no external actuator or drive (e.g., a solenoid), or logic. The gate 14 is automatically moved into the correct position to direct sheets to either the upper or lower vertical paths 12*a* or 12*b* by the vertical motion (impact) of the finishing carriage 20 with an extension 14*a* of the gate 14 extending into its path, as shown.

The module 10 also includes an, e.g., 500 sheet, elevator stacking tray 17, here shown initially located at what would otherwise be the first bin position above the vertical transport central entrance level. This elevator stacker 17 makes effective use for its movement downward (as it fills) in the otherwise lost vertical space between it and the next usable bin below. This position at tray 17 also provides a nigh capacity output location at a level convenient for operator unloading. Since the details of an elevator stacking tray such as 17 per se are well known from the above-cited and other art and products, it need not be described in detail herein. A conventional elevator-moved stacking tray can be used, like those described in the above-cited Mandel 5,098,074 or U.S. Pat. No. 5,137,265; 5,026,034; 4,541,763; or 4,880,350.

As also shown, an optional bypass transport 22, as in FIG. 1, can be substituted and used in the location of two adjacent bins 11, preferably the two bins closest to the output end of central sheet path 12*a*. This bypass 22 passes sheets centrally on to another unit 10 or other finishing module with conventional roller or belt feeders.

This module 10 plural mode center entrance architecture results in a high capacity output tray 17 desirably located near the center of a mailbox bin vertical array, in what would otherwise be wasted space. The elevator tray system 17 moves down within this space as it fills, utilizing this space to allow high capacity stacking. This yields optimum unloading height for the high capacity tray 17, and also, on average, shorter and more reliable paper paths, especially to the elevator stacker 17, which must handle the widest array of sizes/materials, and thus benefits from the straightest possible entrance path. The central sheet entrance geometry here also enables a short bypass path such as 22 on to a second or third such mailbox unit 10 also having the same central level input 13 and central thruput path 12*a*. It enables a common input 13 location for all such mailbox modules, no matter where in a chain of modules and stackers they are located.

Described now in further detail are the general function and features of the exemplary embodiment of a stand-alone printer output "mailbox" job sorting unit 10, with plural bins 11, and an integrated job compiler/-finisher unit, such as 20, although this invention is not limited thereto. As described in said parent and cross-referenced applications, this disclosed system provides for stacking the sheets sequentially outputted from a printer in separate job sets into one or more temporarily and variably assigned "mailboxes" of a "mailboxing" job sorting accessory unit 10 having a number of variably assignable "mailbox" bins 11. A variable display connected to controller 100 may indicate the bin(s) into which that particular user's jobs have been placed last and not yet removed (FIG. 1). These may be plural pre-compiled and/or prestapled job sets stacked in a selected user bin. The exemplary disclosed system may also provide a bypass for sequentially stacking unstapled user sheets directly in a mailbox without compiling and stapling. An exemplary integral moving sheet deflector, compiler and stapler unit 20 is shown more particularly in FIGS. 2 and 3 for collecting, compiling, and optionally stapling, and ejecting job sets of sheets for separate designated users into one or more of these discrete but variably assigned "mailboxes" 11. The disclosed "mailboxing" units may also have "privacy doors" locking for restricting access to at least some of the mailbox bins, with electrical door unlocking of selected bins in response to entry of a user access code, and other user features.

For "mailboxing" functions, the conventionally sequentially received hard copy of plural page collated documents from a pre-collation output electronic printer or the like may be fed into the mailbox unit 10 and automatically fed to the particular bin 11 assignment destination of those job sheets. The mailbox unit 10 preferably directs all designated sheets of a users job to an available bin or bins 11 temporarily assigned to that printer user based on bin availability.

As noted, the disclosed unit 10 is desirably a universal stand-alone unit that is attached to, or even simply moved next to, the output of almost any conventional printer. Plural units 10 may be ganged in series, like plural sorters, if desired, as shown in FIG. 1, for an increased number of available bins, using conventional sheet pass-through feeders and gates and/or the bypass 22 shown herein, or the like. As is well known in sorting, sorter bin units can be extended or serially connected in this manner to provide more available bins. The job sorting unit 10 can take sheets inputted at its sheet input 13 from various printer outputs, including multi-functional units. The input 13 may, if desired, be provided with a pivotal or otherwise vertically adjustable input ramp and/or feeder, which may be in an interface module, to align with various levels of printer outputs. Since the output of the printer may be acquired sequentially as individual unstacked sheets as it outputs, no sheet separator is required for the unit 10, and thus a very simple input feeder can be used. It can even be positioned or adapted to reach into the pre-existing sheet output tray of the printer to pull the sheets out of that tray. The unit 10 input preferably has a conventional sheet input sensor actuated by sensing the entrance of a sheet lead edge into its sheet entrance path 12*a*.

Referring further to the optional bypass transport 22, this provides a short and central bypass extension path through a module 10 on to the central entrance 13 of another module 10. It can be provided simply by removing two adjacent bins in an area adjacent the center of the bin array and mounting into that space a removable simple sheet transport, such as that illustrated, which extends out centrally through and slightly beyond the outer ends of the array of bins, to provide an optional sheet output centrally on the side of the module 10 opposite the entrance 13 side of the module 10, as shown in FIG. 1.

The internal sheet feeding path 12 in the mailbox unit 10 can utilize various known sorter sheet transports, many of which are shown in cited art and other art, providing the sheet path and advantages discussed above are provided. Here, in this example, once each output sheet of the printer has been acquired by the input feeder or the like of an initial common path 12*a* of the unit 10, the further sheet feeding may be done in path 12*b* or 12*c* by the illustrated rollers 25 engaging respective sets of belts 26*a* or 26*b* to form feed nips feeding the sheet along the belts 26 until the sheet meets a bin selection and feeding means 30 which, when activated, deflects the sheet into that selected bin 11, as best seen in FIGS. 2 and 3. Here the inside flight or bight of the two sets of moving belts 26*a* and 26*b* respectively carries the sheet thereon upwardly in path 12*b* (or downwardly in path 12*c* from the center of the unit 10 past a respective series of gates or sheet deflectors 32. The sheet is deflected 11 by a curved surface 32*a* of the gate 32 for a selected bin when the sheet reaches an opened gate 32 adjacent the selected bin or tray 11, as further described below. Where a finisher carriage such as 20 here is provided, the sheet is deflected into that units paper path, which then transports the sheet to the appropriate, adjacent, bin.

As noted, various components of the mailbox unit 10 can be conventional, even commercially available, except as controlled and modified as described herein. Various feeding and gating arrangements whereby inputted sheets are fed to and gated into selected bins by a moving gate with a positionable sheet deflector, rather than by separate associated deflecting bin gates, as here, are well known in the art. The illustrated moving frictional belts 26 transport system and the plural stationary but pivotal sheet deflectors 32 to selectably deflect sheets from the feed belts 26 into the selected bin 11 are merely exemplary.

As noted, the entire operation of the exemplary mailbox module unit 10 here may be controlled by an integral conventional low cost microprocessor controller 100, conventionally programmable with software for the operations described herein. Such a system has more than ample capability and flexibility for the functions described herein, and also for various other functions if desired, such as jam detection and jam clearance instructions.

Optionally, one bin or tray 11 of the unit 10 may (conventionally) provide an open general use tray or bin. The top most bin of a sorter is often so used for undesignated or unknown users jobs, jam purges, overcapacity jobs too large for regular bins, etc., since it is not limited in stack height by any overlying tray. In the present design such a designated general use tray 11 may the tray or bin 11 located just below the tray 17 output location, where it may be fed sheets via the uppermost or top gate 32 on the lower vertical belt transport 12*c*. Since all users may have to access a general use tray, this central location ensures that all users can reach it easily. Where that tray is to be so designated, then the two trays 11 to be removed for the bypass module 22 are preferably the next two trays below that. i.e., slightly varying from FIG. 1, there would be this one dedicated general use tray 11 above the bypass module 22. Note however that here the high capacity stacking tray 17 is also available for automatic switchover of the printer output to this tray 17 by controller 100 for such modes. The unit 10 may, if desired, also be flexibly modifiable into different size, capacity or spacing tray/bin configurations. Examples of systems for variably mounting shelves and/or movable sheet stacking trays to the same frame unit are shown, for example, in the above-cited Mandel et al. U.S. Pat. No. 5,098,074, and in U.S. Pat. No. 3,907,279. Other such variable shelf mounting systems are well known e.g., for wall-mounting racks or bookshelves, such as a fixed vertically slotted track into which the "J" shaped ends of bookshelf or rack supports are cantilever mounted.

The plural mode system disclosed herein accommodates host-connected printers and other applications where high capacity stackers such as 17 are desired. Especially, printers used as "departmental" printers rather than individual addressed mailboxes.

Optionally, here, instead of the stacking tray 17 conventionally moving down as it fills to maintain the top of the stack slightly below the compiler exit level, the present system can desirably move the compiler/stapler unit 20, or the like, up as tray 17 fills. This optionally allows a simple fixed tray to be used, with no elevator mechanism for that tray, by using the same indexing elevator system as is also used here to direct jobs from the same movable compiler finishing unit 20 to selected mailbox bins 11.

In the illustrated mailbox sheet diversion system 30 example here, plural sheet diverter gates 32 are commonly mounted in line on rotatable shafts 33 to define plural gate units 34. The number and spacing of such gates/shaft units 34 equals the number and spacing of the bins 11. They are closely parallel to, and vertically spaced along, the plural belts 26 sheet transport. The same shafts 33 may also support the sheet path idler rollers 25 forming the sheet feeding nips with that side of the belts 26, as shown. However, instead of being conventionally directly adjacent the bins, (as they could be) in this example the diverter gate units 34 here are horizontally separated from the bins here by the space for (width of) the vertically moving finishing carriage 20, here comprising compiler/stapling unit 90. When one set or unit 34 of the pivotal gates 32 is pivoted, the top surface 32*a*, including end fingers 32*b* of each gate 32, acts as sheet deflectors to deflect sheets off of the sheet transport belts 26 at that gate unit 34 location, and into (or through) the adjacent compiler unit 90 which is located at that selected bin 11 location. The selected single line of gates 32 (one gate unit 34) may be pivoted on shaft 33 by direct mechanical engagement of a cam actuator 35 on the elevator/compiler unit 90 with a gate opening cam follower 36 on the pivotal gate unit 34 shaft 33. This pivots said end fingers 32*b* of that set of gates 32 out through spaces between or on each side of the vertical sheet transport belt(s) 26 so that these fingers 32*b* are positioned to catch the sheets on their top surface 32*a* and deflect them off of the belt transport and into the compiler unit 90.

Meanwhile, all the other pivotal gates 32 are all spring (or gravity) loaded into a closed (vertical) position, in which their rear or left sides 32*c* function as sheet guides or baffles to maintain sheets on the transport belts 26 vertical path passing thereby.

When the pulley/cable or other elevator system for the finishing carriage 20 moves that compiler unit 90 on to a different selected bin position, the previously opened adjacent bin gates reclose, and that other newly selected set of 34 gates 32 is pivoted open. This eliminates the requirement for multiple solenoids, one for each bin, and their wiring for bin selections. That is, here there are plural, but dual mode, gates, which are individually cammed open one at a time by a moving compiler/finisher unit, which also forms part of the sheet path into the selected bin. Thus, this unit 20 here actuates, and forms part of the sheet diversion and bin selection system 30. [Note that moving gate sorters (e.g., Norfin Co. Snelling, et al. U.S. Pat. No. 3,414,254) are known in the sorter art. However, typically these have only a single non-pivotal gate, per se, having one set of non-pivotal deflector fingers between the bins and the belt and/or vacuum sheet transport, always extending into the belts, which single gate is moved up and down past the bins by an elevator mechanism]. In contrast, here the compiler unit 90 is vertically moved up or down to its adjacent bin, not the gates. Various known elevator systems may be used for the compiler/stapler unit here, such as elongated screw shafts rotated by a motor at their top or bottom, or a driven cable belt and pulley system. The unit 20 can conventionally slide up and down on conventional vertical elevator rails or smooth cylindrical rods.

Further referring to FIGS. 2 and 3, this example here of a sheet job set compiling and stapling and/or ejecting system 90, per se, may be, for example, similar to that disclosed and described in Xerox Corporation application Ser. No. 07/888,091, filed May 26, 1992, by the same Barry P. Mandel, et al, now allowed, (D/91697). Another compiling and stapling system is disclosed in his above-cited U.S. Pat. No. 5,098,074. The sequentially incoming sheets from the above-described sheet deflecting or bin gating system 30 here are fed into an input feeding nip 91 of compiler 90. Then, here the sheets are either fed directly through the compiler/stapler unit 90 on into the adjacent bin 11 without compiling or stapling, as shown in the dotted line path; or the sheets may first be compiled in a compiler tray 92 by dropping and being fed backwards and registered against the downhill stacking rear wall 92*a* of this compiling tray 92. During this set compiling and registration, a compiled set discharge arm device 93 (with its driver roller 94) is in an up position out of contact with the discharge idler roller 95 (at the compiler tray 92 outlet), as represented by its illustrated solid line position. That is, during this compiling cycle, this set discharge arm device 93 is in an up position not in contact with any of the sheets in the compiling tray 92. [Note that if single sheets are being sequentially fed straight on through the compiler 90 to the bin 11 without compiling (in a bypass or sorting mode), rollers 94 are held down in engagement with rollers 95.] Once the incoming sheet has been discharged from the sheet entrance rolls nip 91 and drops onto partial compiler tray 92, and slides downhill, the top surface of the incoming sheet is then also contacted by a rotatable frictional flexible compiler belt 96, causing the sheet to be driven back and downhill until it is fully registered against the rear wall 92*a* of the tray 92. This type of compressible open or "floppy belt" jogger or compiler assistance is further disclosed in Canon U.S. Pat. No. 4,883,265, issued Nov. 28, 1989 to N. lida, et al., and U.S. Pat. No. 5,137,265, and EPO 346851. Each subsequent job sheet is compiled on top of the prior sheets on tray 92 in this manner. A conventional lateral registration tamper can also be provided, as in the cited art thereon. That is, once each sheet is discharged and rear registered by the rotation of the floppy belts 96 against the topmost surface of the sheet in the compiling tray 92, the lateral tamper engages to shift each sheet to a lateral registration edge of the tray 92. Because the floppy registration belts 96 are so flexible, and are held only at their top, they are easily deformed in the lateral direction. Note that even during this compiling operation the sheets also partially extended and hang out into the adjacent bin 11, saving overall mailbox width. That is, the compiler tray 92 is only a partial sheet supporting shelf for most sizes of sheets, as in the above-cited Mandel 5,098,074 or Canon 5,137,265.

Once the job set is compiled (the entire job set is stacked) and both longitudinally and laterally registered, the compiled stack may then be attached together, by means of a stapler 97, or stitcher, or other suitable set binding device, as is known in the art. As shown in that art, and otherwise well known, stapling or other binding may be in one corner of the set, or along one edge, or along a central spline as a saddle stitch. However, set stapling is not required here. Whether stapled or not, the discharge device 93 is then automatically lowered onto the top surface of the completed compiled set to form a nip gripping the set between its discharge roller 94 and eject idler rollers 95, as represented by the phantom line position of 93. The compiled (and normally stapled) set is thus driven out of the compiling tray 92 and fully into the adjacent bin 11 to stack therein.

The set discharge device 93 here is exemplary. Set discharge could also be accomplished by a transport belt or mechanical pusher fingers, or other suitable set transport devices. Here, after a set ejection, the sheet discharge nip 94, 95 opens as the device 93 lifts to return to its initial position, and the compiling apparatus 90 is ready to compile another subsequent set of copy sheets thereon after being moved to another bin.

Thus, there is provided integral the unit 10 a single repositionable compact compiling/stapling unit 90 for stacking, registering and attaching sets of printing machine output. In the present system, this same compiler/finisher unit 20 may also be positioned to similarly feed sheets or sets of sheets on top of a stack of sheets in the stacking tray 17. However, as noted, this is a plural mode operating system, which can also function as a single sheet pass-through feeder, feeding sheets directly sequentially into the bin 11 to stack therein, or on to a bypass transport such as 22 to pass sheets sequentially on to another module 10.

If desired, the compiling/stapling unit 90 can increment up after set ejection by a vertical distance related to the set sheet count, so as to eject the next set into that same bin from a higher level, for stacking assistance.

In conclusion, this disclosed design results in an integral bin array and stacker unit without wasted space, and a more central sheet entrance level and paper path more compatible with the output of reproduction machines, and other modules. Furthermore, because it requires less overall paper path length and hardware, especially including interfaces, it may be less expensive than alternative designs overall.

While the embodiment disclosed herein is preferred, it will be appreciated from this teaching that various alternatives, modifications, variations or improvements therein may be made by those skilled in the art, which are intended to be encompassed by the following claims:

What is claimed is:

1. In a sheet output module for the collection, separation and stacking of printed media sheets received from the output of a reproduction apparatus, with multiple separate sheet collection bins in a vertical array, a sheet input for receiving the print media sheets from the output of the reproduction apparatus, and a sheet transport path for transporting the sheets from said sheet input to a selected said bin, the improvement wherein:

said sheet input is at a vertical level intermediately of said module and said vertical bin array;

said vertical bin array is intermediately divided into first and second portions with a vertical space therebetween;

said sheet transport path has a common shared path portion from said central sheet input to a branching position where said sheet transport path branches arcuately in opposite directions, with a first branch path extending upwardly to feed sheets to said first portion of said bins and a second branch path extending downwardly to feed sheets to said second portion of said bins;

a sheet deflector gate is mounted at said branching position for selectively deflecting sheets from said common shared path portion into one of said first and second branch paths;

and a high capacity stacking tray is located within said vertical space between said first and second portions of said vertical array of bins also connecting with said sheet transport path to receive said print media sheets.

2. The sheet output module of claim 1 wherein said sheet transport path is in the general shape of a rotated "T".

3. The sheet output module of claim 1 wherein said first and second branch paths extend past said respective first and second portions of said vertical array of bins.

4. The sheet output module of claim 1, wherein said first and second portions of said bins comprise approximately equal halves of said vertical array of bins.

5. The sheet output module of claim 1, wherein said sheet deflector gate is activated by movement of a movable compiler/finishing unit between said first and second portions of said vertical bin array.

6. The sheet output module of claim 5 wherein said compiler/finishing unit is between said first and second branch paths and said bin array, and feeds said printed media sheets from a selected first or second branch path to a selected said bin.

7. The sheet output module of claim 1 wherein said sheet transport path further includes a bypass extension path system to feed sheets on to said central sheet input of a second said sheet output module, said bypass extension path being at a vertical level intermediately of said module and said vertical bin array and communicating with said common shared path portion from said central sheet input to said branching position and then extending on from between said first and second branch paths.

8. The sheet output module of claim 7 wherein said bypass extension path system extends out through said sheet collection bins centrally between said sheet collection bins.

9. The sheet output module of claim 7 wherein said bypass extension path system is a removable module that fits into a space provided by removing two of said sheet collection bins.

* * * * *